United States Patent [19]

Galloway

[11] 4,091,719

[45] May 30, 1978

[54] WELDING BOOTHS

[76] Inventor: Vernon W. Galloway, 1932 W. Pearl St., Pasco, Wash. 99301

[21] Appl. No.: 774,882

[22] Filed: Mar. 7, 1977

[51] Int. Cl.[2] ..... F23J 11/00

[52] U.S. Cl. ..... 98/33 A; 98/115 R; 55/385 A

[58] Field of Search ..... 98/33 R, 115 SB, 115 R; 55/385 A, DIG. 18; 51/356

[56] References Cited

U.S. PATENT DOCUMENTS

| | | | |
|---|---|---|---|
| 2,907,263 | 10/1959 | Muller | 98/115 R |
| 3,359,882 | 12/1967 | Givry et al. | 98/33 R |
| 3,880,061 | 4/1975 | Hensiek et al. | 98/115 R |
| 3,895,569 | 7/1975 | Miller | 98/115 R |

*Primary Examiner*—William E. Wayner
*Attorney, Agent, or Firm*—Wells, St. John & Roberts

[57] ABSTRACT

A welding booth is described that is comprised of a plurality of individual welding compartments that are gathered in an elongated rectangular cluster. The compartments are joined by a common longitudinal air receiving plenum that leads to a central single upright exhaust stack. Each booth includes a vent screen through which air passes to exhaust fumes from the compartments. The compartments are defined by a central longitudinal wall that extends the full length of the compartment cluster and by a plurality of transverse side walls. The lower edges of the walls are spaced a distance above the floor to allow free communication of air between the compartments. Flexible curtains are provided over the front openings of the individual compartments with the lower edge of each curtain spaced above the floor surface such that outside air may be drawn into the individual compartments from the area beneath the curtains. Thus, air drawn through a compartment will proceed in an inward and upward direction directly past a work station within the compartment that is located elevationally below the vent screen. The operator within the compartment is protected from inhaling the fumes present in nearly all forms of welding operations.

7 Claims, 3 Drawing Figures

WELDING BOOTHS

BACKGROUND OF THE INVENTION

Growing concern over environmental working conditions has led to the development of several government controlled standard setting agencies. These agencies actively inspect and set minimum standards for safe operation in industrial and construction environments. The field of gas and electric welding has come under scrutiny of the agencies and strict requirements have been made to protect the welders from the noxious fumes emitted by the welding materials during operation, especially within confined areas. These strict requirements are closely enforced particularly within instructional facilities wherein groups of welders are taught within enclosed confined quarters. The hygenic standards of O.S.H.A. has set the maximum allowable toxic fume inhalation within welding booths at 5 milligrams of iron oxide per cubic meter of air in the breathing zone over an 8-hour period. Previous facilities for welding instruction are not capable of meeting this standard. It has therefore become desirable to provide some form of welding ventilation and housing facility that will meet the strict standards set by the governmental agencies as well as protect the adjacent welders from the intense and damaging light emitted during welding operations.

It is therefore a primary object of the present invention to provide a welding booth wherein a number of welders may perform welding functions in a safe manner and in which the maximum allowable toxic fume inhalation is held at a level well below the maximum allowable set by the governmental agencies.

Another important object is to provide such a welding booth that is compartmented to accommodate a plurality of welders who may work independently and without fear of interference from the remaining welders within the booth.

A still further object is to provde such a booth that is relatively simple in construction and may easily replace existing booth facilities that presently do not meet the strict standards set by the governmental agencies.

These and still further objects and advantages will become apparent upon reading the following description which, taken with the accompanying drawings, discloses a preferred form of my invention. It should be noted however that the description and drawings are used merely to set forth and exemplify a preferred form of the invention and that such description and drawings are in no way intended to restrict the scope of my invention. Only the claims found at the end of this specification are to be understood as placing strict restrictions upon the scope of my invention.

BRIEF DESCRIPTION OF THE DRAWINGS

A preferred form of the present invention is illustrated in the accompanying drawings in which.

DETAILED DESCRIPTION OF A PREFERRED EMBODIMENT

Figure 1:
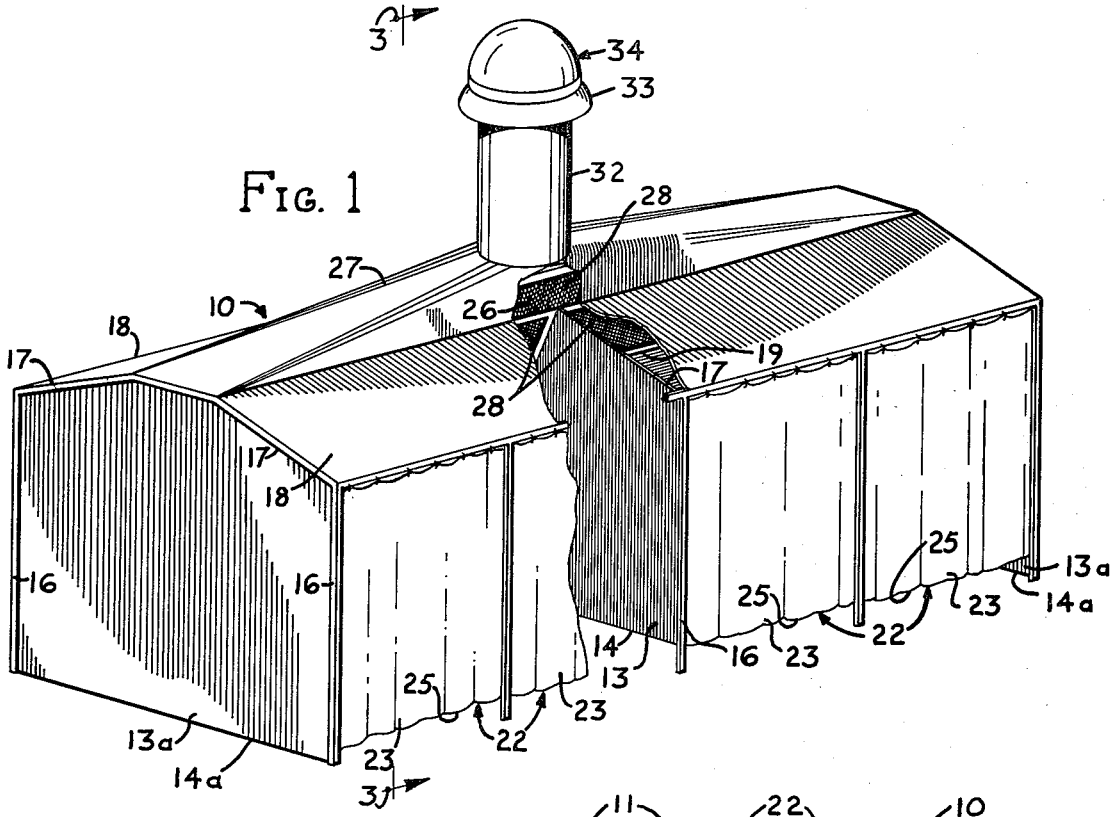
FIG. 1 is a pictorial view of the present booth structure with a portion thereof broken away.
Figure 2:
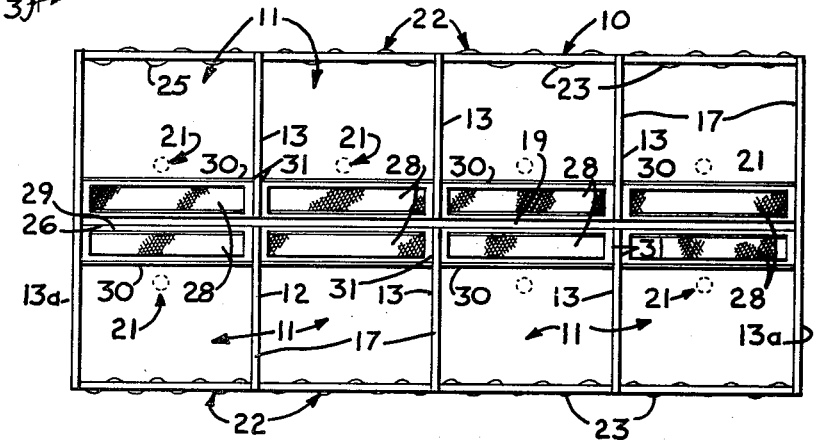
FIG. 2 is a reduced plan view showing the booth with the covering structure thereof removed.

The present booth structure is illustrated in the accompanying drawings and is designated therein by the reference character 10. The booth 10 is comprised of a cluster of individual welding compartments 11. These compartments 11 are arranged in a rectangular cluster as determined by a tubular support frame 12.

The individual compartments 11 include side walls 13 and opposed end walls **13*a* that are oriented transverse to the longitudinal dimension of the booth. The side walls 13 are spaced apart along the length of the booth to define opposite lateral sides of the individual compartments. Each side wall 13 includes a lower side wall edge 14 that is spaced elevationally above the ground or floor support surface 15. The end walls 13*a* include lower edges 14*a* that meet the ground or floor surface 15. The walls 13 and 13*a* also include vertical side edges 16 that lead upwardly to inclined top edges 17. The side and end walls 13 and 13*a* are covered completely by a common roof structure 18**.

A central longitudinal wall 19 extends the full length of the booth 10 between walls **13*a* and defines the inner wall closing of the individual compartments. The central longitudinal wall 19 also includes a longitudinal lower edge 20 that is spaced above the floor or ground surface 15 similarly to the lower side wall edges 14. Wall 19 and end and side walls 13, 13*a* are all supported by the tubular support frame structure 12**.

A number of work stations are provided within the booth 10. The general locations of such work stations are indicated at 21. There is a single work station for each compartment 11. The stations are located within compartments 11 toward the central longitudinal wall 19. The work stations are strategically located for the purpose of placing the workpiece in the path of incoming ventilation air that, through provision of my invention, passes through the booth without endangering the occupants of the several compartments.

Figure 3:
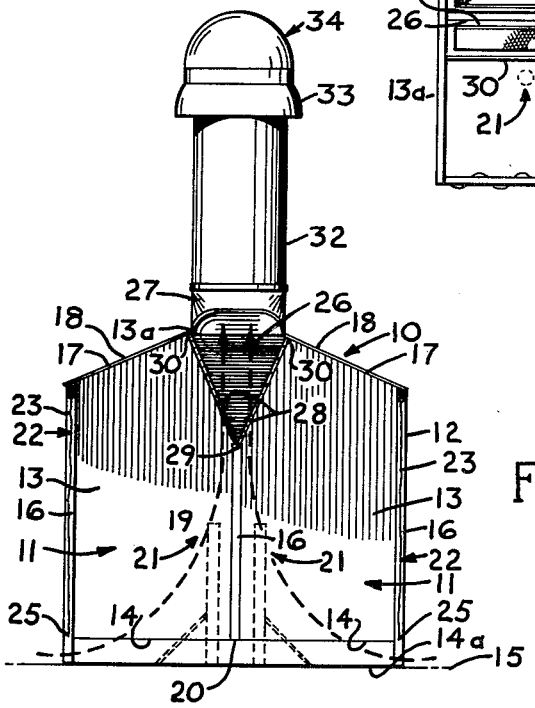
FIG. 3 is a reduced sectional view taken along line 3—3 in FIG. 1.

The walls **13, 13*a* and central longitudinal wall 19 enclose the compartments on three sides leaving an outwardly facing entrance for each compartment. The entrances are selectively closed by a closure means 22. Specifically, it is preferred that the closure means be comprised of semi-opaque fire resistant curtains as illustrated at 23. Such curtains 23 may include top edge hangers 24 that will be loosely supported by the support frame 12. The length of curtains 23 is selected to be such that a bottom edge 25 of each curtain is elevated from the floor or ground surface 15. Elevation of the curtain lower edge 25** is intended to allow free passage of outside air into the individual compartments in an inward and upward direction as indicated by the dashed lines in FIG. 3.

A central air receiving plenum 26 is located within the booth and is operatively associated with the compartments through the roof structure 18. The plenum 26 is defined partially by a formed sheet metal transition manifold 27 that is fixed to the roof structure and extends the full length of the booth. Each compartment 11 includes a vent screen 28 that is formed of expanded steel, preferably one quarter inch by 18 gauge flat pattern. Screens 28 define the remainder of plenum 26. They include lower horizontal edges 29 that join the central longitudinal wall 19. They also include upper horizontal edges 30 that are spaced apart laterally such that the planar expanded steel faces of the screens are inclined and face slightly downward and inward. The upper edges 30 are joined to the roof structure 18. Vertical side edges 31 of the screens 28 are joined to the walls 13, 13a.

The plenum 26 is designed to receive and direct air from opposite ends of the booth longitudinally inward toward a central single exhaust stack 32. The stack 32 is selected for capacity to accommodate the total volume of air and fumes passing through the several compartments 11. Stack 32 leads upwardly through the ceiling and roof structure of the associated building to an exhaust shroud 33. A blower means 34 may be located within this shroud in order to produce a negative pressure within the plenum for drawing air through the screens from within the compartments 11. It is preferred that the blower means be a form of fan that is capable of pulling at least 400 cfm through the screens of each compartment 11.

During operation, all compartments 11 may be occupied simultaneously by welders engaged in various forms of welding operations. The blower means 34 will be continuously operated during such welding operations to produce the desired negative pressure within the plenum 26 to pull the toxic fumes from the welding processes through screens 28 and eventually out through the stack 32.

The particular design of the booth facilitates passage of the air in a path through the compartments such that the operator or welder is constantly protected from the dangerous fumes. The path of air passing through the compartments is illustrated, as briefly discussed above, by dashed lines in FIG. 3. This air passage leads inward and upward past the work stations at 21 and directly through the vents 28. The air is drawn from outside the curtains 23 through the air space between the floor or ground surface 15 and the lower curtain edges 25. No substantial amounts of air are taken from adjacent compartments because the negative pressures within the compartments are maintained at substantially equal pressure. The end walls 13a extend to the ground or floor surface to prevent undesired entrance of outside air from the ends of the booth. Therefore, the only substantial amounts of air will enter the compartments 11 from outside the booth and only from under curtains 23. It has been found that a blower capable of drawing air through the screens at the rate of 400 cubic feet per minute minimum is sufficient to meet all current governmental standards.

The above description and attached drawings are given to set forth a preferred form of the present invention. However, it is understood that various changes and modifications may be made therein without departing from the scope of my invention. Therefore, only the following claims are to be taken as restrictions upon the scope of my invention.

What I claim is:

1. A ventilated multi-compartment welding booth, comprising:

a supporting frame defining a series of welding compartments arranged in an elongated rectangular cluster;

a plurality of side walls transversely oriented to the longitudinal dimension of the frame and defining outwardly facing front entrance to the individual compartments;

a central longitudinal partition wall extending the length of the frame and joined with the side walls thereby enclosing the booths on three sides;

a common roof structure covering the cluster of compartments;

closure means spanning the front entrance of the compartments for selectively closing the front openings;

said closure means having bottom closure edges space elevationally above the ground or floor surface to allow free passage of outside air under the bottom closure edges and into the associated compartments;

a central longitudinal air plenum operatively associated with the booths through the roof structure and leading to a central exhaust stack;

vent screens on the frame openly interconnecting each compartment with the plenum and wherein the screens are joined at lower horizontal edges thereof to the central wall and to the roof structure at upper horizontal edges;

work stations within each compartment adjacent the central wall and elevationally below the associated vent screens; and blower means associated with the plenum for drawing air through the screens from under the elevated bottom edges of the closure means thereby creating an inward and upward moving air current that passes by the work stations and directly enters the plenum through the screens.

2. The booth as defined by claim 1 wherein the closure means is comprised of a fire resistant curtain hung across each compartment front opening.

3. The booth as defined by claim 1 wherein the screens are inclined with the upper horizontal edges spaced apart laterally.

4. The booth as set out by claim 1 wherein the blower means has the capacity to pull air and welding fumes through the screens at a minimum of 400 cubic feet per minute.

5. The booth as set out by claim 1 wherein the screens are formed of expanded steel.

6. The booth as set out by claim 1 wherein the side walls and central wall include lower horizontal edges spaced elevationally above the ground or floor surface.

7. The booth as set out by claim 1 wherein the vent screens include vertical side edges and the side walls are joined to the roof structure and to the vertical side edges of the vent screens.

* * * * *